US011427946B2

(12) United States Patent
Choi et al.

(10) Patent No.: US 11,427,946 B2
(45) Date of Patent: Aug. 30, 2022

(54) METHOD FOR CONTROLLING SPIN-DRYING CYCLE OF LAUNDRY TREATMENT MACHINE

(71) Applicant: LG ELECTRONICS INC., Seoul (KR)

(72) Inventors: Moonsuk Choi, Seoul (KR); Kyunghoon Kim, Seoul (KR); Younghan Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 16/498,635

(22) PCT Filed: Mar. 27, 2018

(86) PCT No.: PCT/KR2018/003584
§ 371 (c)(1),
(2) Date: Sep. 27, 2019

(87) PCT Pub. No.: WO2018/182277
PCT Pub. Date: Oct. 4, 2018

(65) Prior Publication Data

US 2021/0115611 A1 Apr. 22, 2021

(30) Foreign Application Priority Data

Mar. 27, 2017 (KR) ..... 10-2017-0038495

(51) Int. Cl.
*D06F 35/00* (2006.01)
*D06F 33/48* (2020.01)
(Continued)

(52) U.S. Cl.
CPC ..... *D06F 33/48* (2020.02); *D06F 21/00* (2013.01); *D06F 34/16* (2020.02); *D06F 37/20* (2013.01);
(Continued)

(58) Field of Classification Search
CPC ..... D06F 18/00; D06F 21/00; D06F 21/02; D06F 21/04; D06F 23/00; D06F 23/02;
(Continued)

(56) References Cited

U.S. PATENT DOCUMENTS

2007/0124871 A1* 6/2007 Kwon ..... D06F 33/40 8/159
2009/0183318 A1* 7/2009 Kim ..... D06F 37/225 8/159
(Continued)

FOREIGN PATENT DOCUMENTS

CN 101177872 A 5/2008
CN 101492874 A 7/2009
(Continued)

*Primary Examiner* — David G Cormier
(74) *Attorney, Agent, or Firm* — Dentons US LLP

(57) ABSTRACT

Disclosed is a method for controlling a spin-drying cycle of a laundry treatment machine. The method includes performing a plurality of spin-drying operations by rotating a drum above an adjusted rotational speed range configured to adjust disposition of balls within a ball balancer so as to correspond to a changed amount of eccentricity, and adjusting the disposition of the balls within the ball balancer by rotating the drum within the adjusted rotational speed range, between the respective spin-drying operations.

11 Claims, 10 Drawing Sheets

(51) Int. Cl.

| | |
|---|---|
| ***D06F 34/16*** | (2020.01) |
| ***D06F 21/00*** | (2006.01) |
| ***D06F 37/20*** | (2006.01) |
| ***D06F 49/06*** | (2006.01) |
| *D06F 33/40* | (2020.01) |
| *D06F 103/26* | (2020.01) |
| *D06F 105/48* | (2020.01) |
| *D06F 37/22* | (2006.01) |

(52) U.S. Cl.
CPC ..... *D06F 49/06* (2013.01); *D06F 33/40* (2020.02); *D06F 35/007* (2013.01); *D06F 37/225* (2013.01); *D06F 2103/26* (2020.02); *D06F 2105/48* (2020.02)

(58) Field of Classification Search
CPC ..... D06F 23/025; D06F 25/00; D06F 33/00; D06F 33/40; D06F 33/48; D06F 33/76; D06F 34/08; D06F 34/16; D06F 35/00–008; D06F 37/00; D06F 37/203; D06F 37/22; D06F 37/225; D06F 37/24; D06F 37/245; D06F 39/00; D06F 58/00; D06F 58/02; D06F 58/04; D06F 58/20; D06F 58/203; D06F 58/30; D06F 2103/26; D06F 2103/46; D06F 2202/00; D06F 2202/10; D06F 2202/12; D06F 2204/00–10; D06F 2220/00
See application file for complete search history.

(56) References Cited

U.S. PATENT DOCUMENTS

| | | | | |
|---|---|---|---|---|
| 2012/0151695 | A1* | 6/2012 | Jang | D06F 37/245 8/137 |
| 2014/0379142 | A1* | 12/2014 | Borlin | D06F 37/245 700/279 |
| 2015/0013077 | A1 | 1/2015 | Jung et al. | |
| 2015/0233037 | A1 | 8/2015 | Kim et al. | |

FOREIGN PATENT DOCUMENTS

| | | | |
|---|---|---|---|
| CN | 104631037 | A | 5/2015 |
| EP | 2692928 | A1 | 2/2014 |
| EP | 3252201 | A1 | 12/2017 |
| JP | 2016-198248 | A | 12/2016 |
| KR | 10-2005-0062792 | A | 6/2005 |
| KR | 10-2007-0072748 | A | 7/2007 |
| KR | 10-2009-0080608 | A | 7/2009 |
| KR | 10-2011-0014433 | A | 2/2011 |
| KR | 10-2011-0022494 | A | 3/2011 |
| KR | 10-1171315 | B1 | 8/2012 |
| WO | 2016/163081 | A1 | 10/2016 |

* cited by examiner

METHOD FOR CONTROLLING SPIN-DRYING CYCLE OF LAUNDRY TREATMENT MACHINE

This application is a National Phase of PCT International Application No. PCT/KR2018/003584, filed on Mar. 27, 2018, which claims priority under 35 U.S.C. 119(e) to Korean Application No. 10-2017-0038495 filed on Mar. 27, 2017 which is hereby incorporated by reference herein in its entirety.

TECHNICAL FIELD

The present invention relates to a method for controlling a spin-drying cycle of a laundry treatment machine, and more particularly to a method for controlling spin-drying of laundry using a laundry treatment machine.

BACKGROUND ART

In general, a laundry treatment machine is an apparatus which washes clothes, bedclothes, etc. (hereinafter, referred to as 'clothes') using water, detergents and mechanical action through a series of processes of washing, rinsing, spin-drying, etc., so as to remove contaminants from the clothes.

The laundry treatment machine generally performs a washing cycle, a rinsing cycle and a spin-drying cycle. Here, the spin-drying cycle includes rotation of a drum at the highest speed, and thus, a measure to overcome increased noise and vibration due to unbalanced rotation of the drum occurring during a process of rotating the drum at a high speed in the spin-drying cycle is required.

A laundry treatment machine has a balancer which reduces unbalance occurring due to unequal distribution of clothes accommodated in the drum, and a ball balancer or a liquid balancer may be used as the balancer of the laundry treatment machine. The ball balancer in which balls move to reduce unbalance occurring due to rotation of the drum, but if the drum is rotated at a designated speed or higher, movement of the balls in the ball balancer is difficult, and thus a measure to reduce unbalanced rotation of the drum caused by removal of water from the clothes in the spin-drying cycle is required.

DISCLOSURE

Technical Problem

Therefore, the present invention has been made in view of the above problems, and it is an object of the present invention to provide a method for controlling a spin-drying cycle of a laundry treatment machine, in which unbalanced rotation of a drum caused by removal of water from clothes during a spin-drying process is reduced.

It is another object of the present invention to provide a method for controlling a spin-drying cycle of a laundry treatment machine, in which unbalanced rotation of a drum occurring due to accelerating or decelerating rotation of the drum is reduced.

Objects of the present invention are not limited to the above-described objects, and other objects which are not stated above will be more clearly understood from the following detailed description.

Technical Solution

In accordance with an aspect of the present invention, the above and other objects can be accomplished by the provision of a method for controlling a spin-drying cycle of a laundry treatment machine, including performing a plurality of spin-drying operations by rotating a drum above an adjusted rotational speed range configured to adjust disposition of balls within a ball balancer so as to correspond to a change in an amount of eccentricity, and adjusting the disposition of the balls within the ball balancer by rotating the drum within the adjusted rotational speed range, between the respective spin-drying operations, thereby coping with the change in the amount of eccentricity caused by removal of water in the respective spin-drying operations.

In accordance with another aspect of the present invention, there is provided a method for controlling a spin-drying cycle of a laundry treatment machine, including performing a plurality of spin-drying operations by rotating a drum above an adjusted rotational speed range configured to adjust disposition of balls within a ball balancer so as to correspond to a change in an amount of eccentricity, and adjusting the disposition of the balls within the ball balancer by rotating the drum within the adjusted rotational speed range, prior to each of the spin-drying operations, thereby coping with the change in the amount of eccentricity caused by removal of water in the respective spin-drying operations.

The spin-drying operations may include a preliminary spin-drying operation performed by rotating the drum within a RPM range of a resonance point of a cabinet or lower, and a main spin-drying operation performed by rotating the drum within an RPM range of above the resonance point of the cabinet, and the disposition of the balls within the ball balancer may be adjusted by rotating the drum within the adjusted rotational speed range, between the preliminary spin-drying operation and the main spin-drying operation, thereby coping with the change in the amount of eccentricity caused by removal of water in the preliminary spin-drying operation.

The main spin-drying operation may be divided into a first spin-drying operation performed by rotating the drum to a rotational speed of above the resonance point of the cabinet, a second spin-drying operation performed by rotating the drum at a maximum rotational speed higher than a maximum rotational speed of the drum in the first spin-drying operation, and a third spin-drying operation performed by rotating the drum at a maximum rotational speed for a longer time than in the second spin-drying operation, and the disposition of the balls with the ball balancer may be adjusted by rotating the drum within the adjusted rotational speed range, between the respective spin-drying operations, thereby coping with the change in the amount of eccentricity caused by removal of water between the respective operations divided from the main spin-drying operation.

In the first spin-drying operation, if the change in the amount of eccentricity due to removal of water is large during the rotation of the drum at a rotational speed of the resonance point of the cabinet or lower, the drum may be rotated at the rotational speed of the resonance point of the cabinet or lower, thereby preventing excessive vibration occurring from the drum.

In the first spin-drying operation, when a difference between a maximum vibration value within a first set rotational speed range set to the resonance point or lower, and a maximum vibration value within a second set rotational speed range set to be resonance point or lower, which is higher than the first set rotational speed range, exceeds a set value, the rotational speed of the drum may be maintained within the second set rotational speed range, and the first set rotational speed range and the second set rotational speed range may be set as sections in which removal of water is great, thereby preventing excessive vibration occurring during rotation of the drum at a rotational speed of above the resonance point of the cabinet.

The main spin-drying operation may include increasing the rotational speed of the drum to a maximum rotational speed, and decreasing the rotational speed of the drum from the maximum rotational speed, and the decreasing the rotational speed of the drum may include a ball disposition maintenance section configured to prevent excessive vibration of the cabinet occurring during a process of decreasing the rotational speed of the drum, thereby preventing excessive vibration of the drum occurring during the decelerating rotation of the drum.

Advantageous Effects

First, a method for controlling a spin-drying cycle of a laundry treatment machine in accordance with the present invention includes adjusting disposition balls within a ball balancer by rotating a drum within an adjusted rotational speed range, between a preliminary spin-drying operation and a main spin-drying operation, thus preventing excessive vibration of a cabinet occurring due to unbalanced rotation of the drum caused by removal of water in the spin-drying cycle.

Second, the method in accordance with the present invention includes adjusting disposition of the balls within the ball balancer by rotating the drum within the adjusted rotational speed range, among first to third spin-drying operations in which the drum is rotated at a rotational frequency of a resonance point or above, thus preventing excessive vibration of the cabinet occurring due to unbalanced rotation of the drum caused by removal of water in the spin-drying cycle.

Third, in the method in accordance with the present invention, when an amount of removed water is within or above a designated range during a process of spin-drying at the resonance point or lower in the first spin-drying operation, the rotational speed of the drum is not increased to a rotational speed of the resonance point or higher, and thus, excessive vibration of the cabinet occurring due to rotation of the drum at the rotational speed of the resonance point or higher may be prevented.

The effects of the present invention are not limited to the above-described effects, and various other effects of the invention will be directly or implicitly set forth in the following detailed description and the accompanying claims.

BEST MODE

The advantages and features of the present invention and the way of attaining the same will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

Hereinafter, a laundry treatment machine and a method for controlling the same in accordance with embodiments of the present invention will be described with reference to the accompanying drawings.

Figure 1:
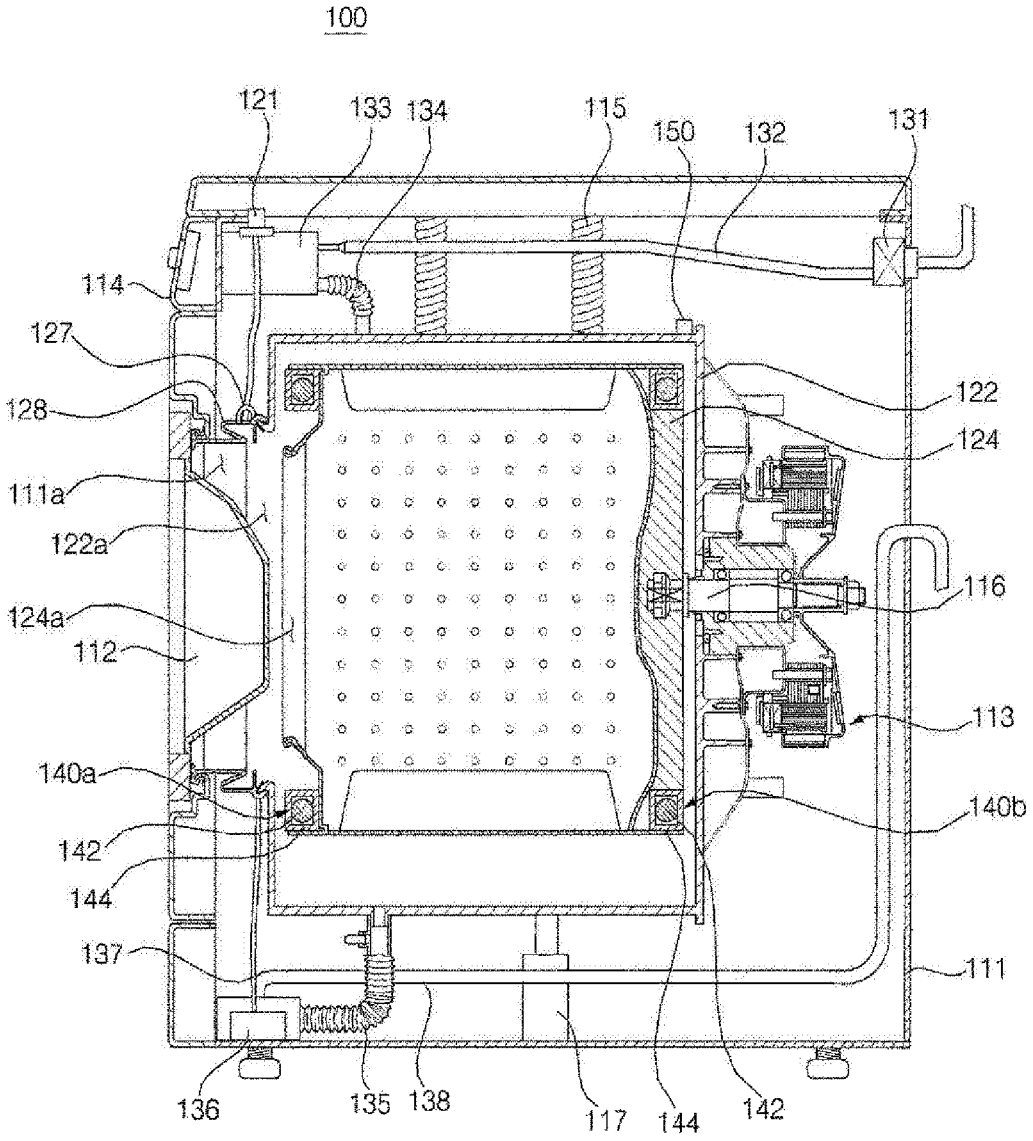
FIG. 1 is a longitudinal-sectional view illustrating the configuration of a laundry treatment machine in accordance with a first embodiment of the present invention.

FIG. 1 is a longitudinal-sectional view illustrating the configuration of a laundry treatment machine in accordance with a first embodiment of the present invention.

Referring to FIG. 1, a laundry treatment machine 100 in accordance with one embodiment of the present invention includes a cabinet 111 which forms the external appearance of the laundry treatment machine, a door 112 which opens and closes one side of the cabinet so that clothes are put into and taken out of the cabinet therethrough, a tub 122 which is disposed within the cabinet so as to be supported by the cabinet, a drum 124 which is disposed within the tub so as to be rotated in a state in which the clothes are accommodated in the drum, a driver 113 which applies torque to the drum so as to rotate the drum, a detergent box 133 in which detergents are accommodated, and a control panel 114 which receives user input and displays the state of the laundry treatment machine.

A clothes entrance 111*a* is formed in the cabinet 111 so that clothes may be put into and taken out of the cabinet therethrough. The door 122 is rotatably coupled to the cabinet 111 so as to open and close the clothes entrance 111*a*. The control panel 114 is provided on the cabinet 111. The detergent box 133 may be provided in the cabinet 111 so as to be capable of withdrawn.

The tub 122 is disposed within the cabinet 111 so as to be buffered using springs 115 and a damper 117. The tub 122 holds washing water. The tub 122 is disposed outside the drum 124 so as to surround the drum 124.

A tub hole 122*a* is formed through the front surface of the tub 122. The tub hole 122*a* is formed so as to communicate with the clothes entrance 111*a* such that clothes may be put into and taken out of the drum 124 therethrough.

The driver 113 is disposed at the rear of the tub 122 and generates rotational force. The driver 113 is connected to a rotation shaft 116 and rotates the drum 124. The driver 113 may rotate the drum 124 at various speeds or in various directions. The driver 113 includes a stator (not shown), on which a coil is wound, and a rotor (not shown), which is rotated through electromagnetic interaction with the coil.

The rotation shaft 116 connects the driver 113 to the drum 124. The rotation shaft 116 transmits rotational force of the driver 113 to the drum 124, thus rotating the drum 124. One end of the rotation shaft 116 is coupled to the center of rotation of the rear portion of the drum 124, and the other end is coupled to the rotor (not shown) of the driver 113.

The drum 124 in which the clothes are accommodated is rotated. The drum 124 is disposed within the tub 122. The drum 124 has a cylindrical shape which is rotatable. A plurality of through holes, through which washing water passes, is formed through the drum 124. The drum 124 receives rotational force of the driver 113, thus being rotated.

A drum hole is formed through the front surface of the drum 124. The drum hole 124*a* is formed so as to communicate with the clothes entrance 111*a* and the tub hole 122*a* such that clothes may be put into and taken out of the drum 124 therethrough. A front ball balancer 140*a* is coupled to the front edge of the drum 124, and a rear ball balancer 140*b* is coupled to the rear edge of the drum 124.

Each of the front and rear ball balancers 140*a* and 140*b* includes balls 142 and a filling fluid therein. Further, each of the ball balancers 140*a* and 140*b* may further include a balancer housing 144 which defines a moving path of the balls 142 along the inner circumference or the outer circumference of the drum 124. That is, the balancer housing 144 may be provided along the inner circumference or the outer circumference of the drum, and the balls 142 may move within the balancer housing 144.

A gasket 128 seals a gap between the tub 122 and the cabinet 111. The gasket 128 is disposed between the inlet of the tub 122 and the clothes entrance 111*a*. The gasket 128 relieves impact transmitted to the door 112 when the drum 124 is rotated, and simultaneously prevents washing water in the tub 122 from leaking to the outside. A circulation nozzle 127 which sprays washing water to the inside of the drum 124 may be provided at the gasket 128.

A water supply valve 131 which adjusts inflow of washing water from an external water source, a water supply flow path 132 along which washing water flowing through the water supply valve flows to the detergent box 133, and a water supply pipe 134 along which washing water mixed with a detergent in the detergent box 133 flows to the inside of the tub 122 may be provided within the cabinet 111.

A drain pipe 135 to which washing water in the tub 122 is discharged, a pump 136 which pumps the washing water in the tub, a circulation flow path 137 which circulates washing water, the circulation nozzle 127 which sprays washing water to the inside of the drum 124, and a drain flow path 138 along which washing water is drained to the outside may be provided within the cabinet 111. According to embodiments, the pump 136 may include a circulation pump and a drain pump which are connected to the circulation flow path 137 and the drain flow path 138, respectively.

A vibration sensor 150 which senses a magnitude of vibration of the tub 122 may be provided on the tub 122. Vibration occurring due to unbalance of the drum 124 is transmitted to the tub 122 by the rotation shaft 116, thus causing vibration of the tub 122. The vibration sensor 150 senses the magnitude of vibration of the tub 122, thus measuring a degree of unbalance of the drum 124.

Vibration sensors may include a front vibration sensor which is disposed at the front portion of the tub 122 and senses a magnitude of vibration of the front portion of the tub 122, i.e., a magnitude of front vibration, and a rear vibration sensor which is disposed at the rear portion of the tub 122 and senses a magnitude of vibration of the rear portion of the tub 122, i.e., a magnitude of rear vibration. In the laundry treatment machine 100 in accordance with this embodiment, the vibration sensor 150 may be disposed at the rear portion of the upper region of the tub 122.

An input unit (not shown) which receives selection of a washing course or various operation commands, such as operating times of respective cycles, reservation, etc., from a user, and a display unit (not shown) which displays the operating state of the laundry treatment machine 100 may be provided on the control panel 114.

Figure 2:
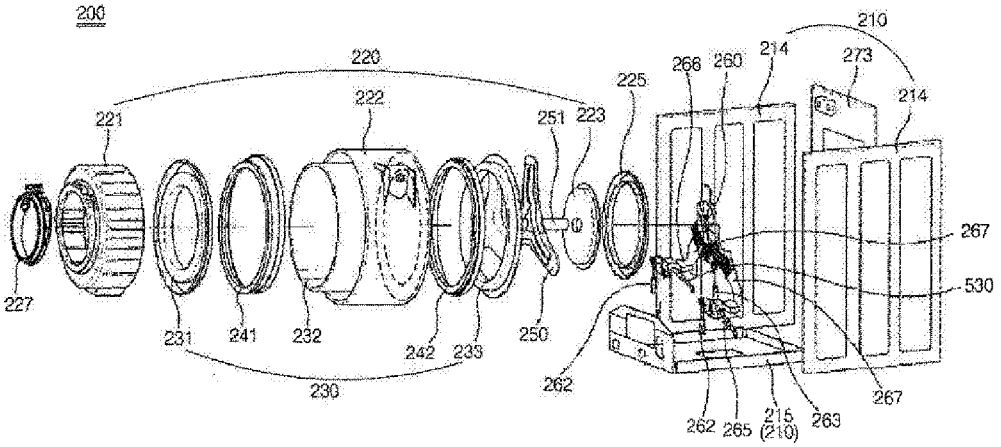
FIG. 2 is a partial exploded perspective view illustrating a laundry treatment machine in accordance with a second embodiment of the present invention.
Figure 3:
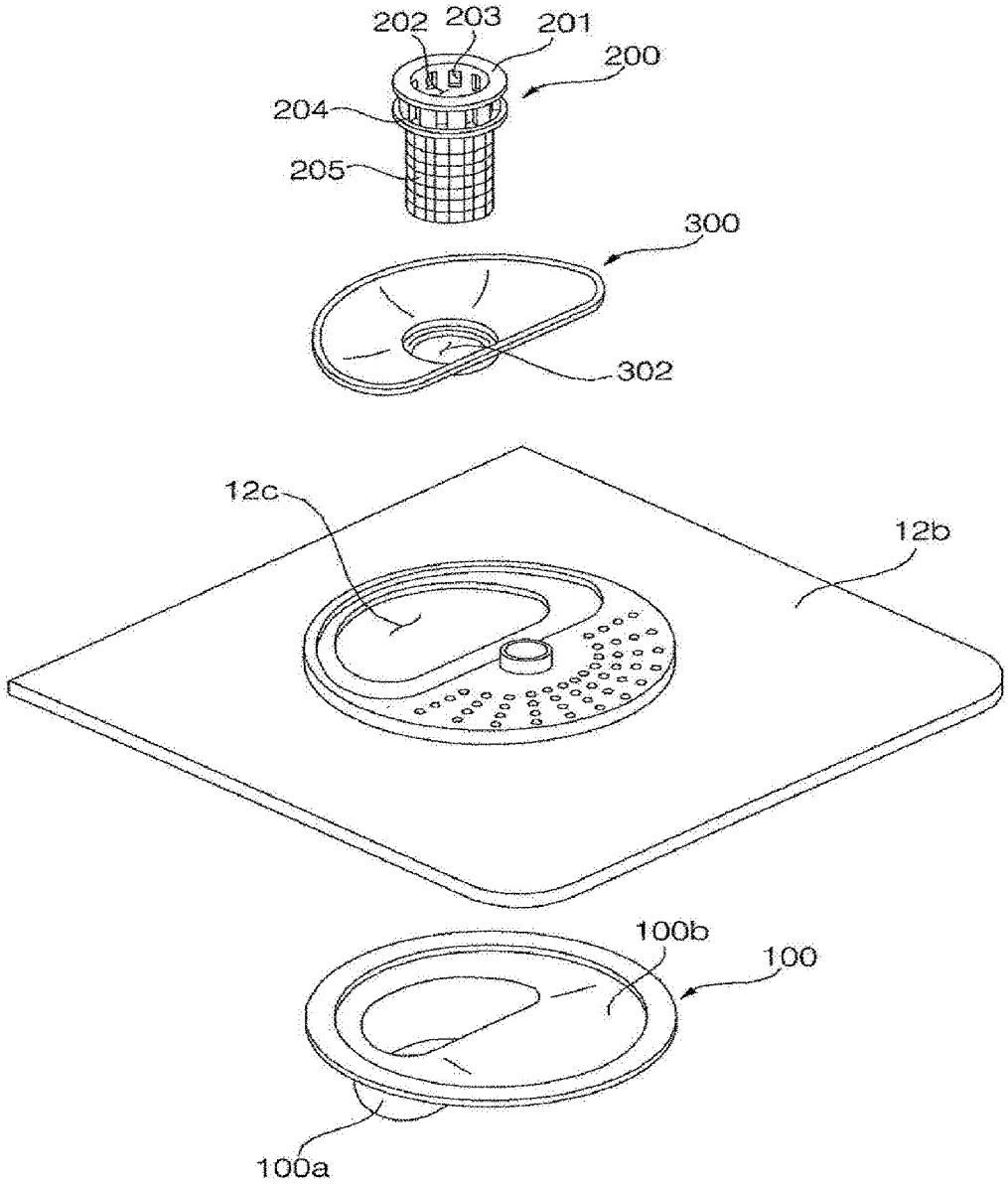
FIG. 3 is an assembled sectional view of FIG. 2.

FIG. 2 is a partial exploded perspective view illustrating a laundry treatment machine in accordance with a second embodiment of the present invention, and FIG. 3 is an assembled sectional view of FIG. 2.

Referring to FIGS. 2 and 3, in a laundry treatment machine 200, a tub 220 is fixedly supported by a cabinet 211. The tub 220 includes a tub front 221 which forms the front portion of the tub, and a tub rear 222 which forms the rear portion of the tub. The tub front 221 and the tub rear 222 may be assembled by screws. The tub 220 has an opening in the rear surface thereof. The inner circumference of the rear surface of the tub 220 is connected to the outer circumferential portion of a rear gasket 225. The inner circumferential portion of the rear gasket 225 is connected to a tub back 223. A through hole through which a rotation shaft passes is formed through the center of the tub back 223. The rear gasket 225 is formed of a flexible material so as not to transmit vibration of the tub back 223 to the tub 220.

The rear surface of the tub 220, the tub back 223, and the rear gasket 225 form a rear wall of the tub. The rear gasket 225 are respectively connected to the tub back 223 and the tub rear 222 so as to be sealed, thus preventing washing water in the tub from leaking. The rear gasket 225 may have a bellows part 226 which may extend a sufficient length so as to permit such relative motion of the tub back 223.

A front gasket 227, which prevents foreign substances from being introduced into a gap between the tub and the drum, is connected to the front portion of the tub 220. The front gasket 227 is formed of a flexible material, and is fixedly installed at the front portion of the tub 220. The front gasket 227 may be formed of the same material as the rear gasket 225.

The cabinet 211 forms the external appearance of the laundry treatment machine 200. The cabinet 211 includes a front cabinet (not shown), a rear cabinet 213, side cabinets 214, an upper cabinet (not shown) and a base cabinet 215.

The drum 230 includes a drum front 231, a drum center 232, a drum back 233, etc. The drum 230 accommodates clothes therein and is rotated. The drum 230 is disposed within the tub 220.

Ball balancers 240*a* and 240*b* are installed at the front and rear portions of the drum 230. Each of the front and rear ball balancers 240*a* and 240*b* includes balls 242 and a filling fluid therein. Further, each of the ball balancers 240*a* and 240*b* may further include a balancer housing 144 which defines a moving path of the balls 242 along the inner circumference or the outer circumference of the drum 224.

The rear surface of the drum 230 is connected to a spider 250, and the spider 250 is connected to a rotation shaft 251.

The drum 230 is rotated within the tub 220 by rotational force transmitted through the rotation shaft 251.

The rotation shaft 251 passes through the tub back 223, and is connected to a driver 252 in a direct connection manner. A bearing housing 260 is coupled to the rear surface of the tub back 223. The bearing housing 260 between the driver 252 and the tub back 223 rotatably supports the rotation shaft 251.

A stator 253 is fixedly installed at the bearing housing 260. A rotor 254 is located so as to surround the stator 253. The rotor 254 is directly connected to the rotation shaft 251. The driver 252 is an outer rotor-type motor, and is directly connected to the rotation shaft 251.

The bearing housing 26 is supported by the base cabinet 215 through a suspension unit. The suspension unit 261 includes three vertical supports and two inclined supports, which are inclined in forward and rearward directions.

The suspension unit 261 in accordance with this embodiment may include two front cylinder springs, one rear cylinder spring, and two cylinder dampers 265.

The front cylinder springs 262 connect suspension brackets 266 to the base cabinet 215. The rear cylinder spring 263 directly connects the bearing housing 260 to the base cabinet 215. The cylinder dampers 265 are installed between the suspension brackets 266 and the rear portion of the base cabinet 215 so as to be inclined.

The cylinder springs 262 and 263 of the suspension unit 261 are not completely fixedly connected to the base cabinet 215, and may be connected to the base cabinet 215 such that elastic deformation of the cylinder springs 262 and 263 is allowed to some degree and thus movement of the drum in the forward and rearward directions and in the leftward and rightward directions is possible. That is, the cylinder springs 262 and 263 are elastically supported so that rotation thereof about supporting points thereof connected to the base cabinet 215 in the forward and rearward directions and in the leftward and rightward directions is allowed to some degree.

Elements of the suspension unit 261, which are vertically installed, may be configured to elastically buffer vibration of the drum, and elements, which are installed so as to be inclined, may be configured to reduce the vibration. That is, in a vibration system including springs and damping units, elements which are vertically installed may serve as the springs, and elements which are installed so as to be inclined may serve as the damping units.

The tub 220 is fixedly installed in the cabinet 211, and vibration of the drum 230 is buffered by the suspension unit 261. Substantially, support structures of the tub 220 and the drum 230 may be separated from each other. Further, even if the drum 230 is vibrated, the tub 220 may not be vibrated.

The bearing housing 260 and the suspension brackets 266 are connected by weights 267.

A vibration sensor 270 which sense a magnitude of vibration of the tub 220 is provided on the tub 220. Vibration occurring due to unbalance of the drum 230 may be transmitted to the tub 220 by the rotation shaft 251, thus causing vibration of the tub 220. The vibration sensor 270 senses the magnitude of vibration of the tub 220, thus measuring a degree of unbalance of the drum 230. The vibration sensor 270 may senses vibration of the tub 220 in the forward direction or in the leftward and rightward directions. Vibration sensors 270 may be disposed in plural at the front and rear portions of the tub 220. The vibration sensor 270 in accordance with this embodiment may be disposed at the rear portion of the upper region of the tub 220. Clothes are gathered in the rear portion of the drum 230 during the rotating process of the drum 230, and thus, a large magnitude of vibration is sensed at the rear portion of the tub 220.

The laundry treatment machine 220 in accordance with this embodiment further includes a control panel 272 including an input unit (not shown) which receives selection of a washing course or various operation commands, such as operating times of respective cycles, reservation, etc., through a user, and a display unit (not shown) which displays the operating state of the laundry treatment machine 200.

Figure 4:
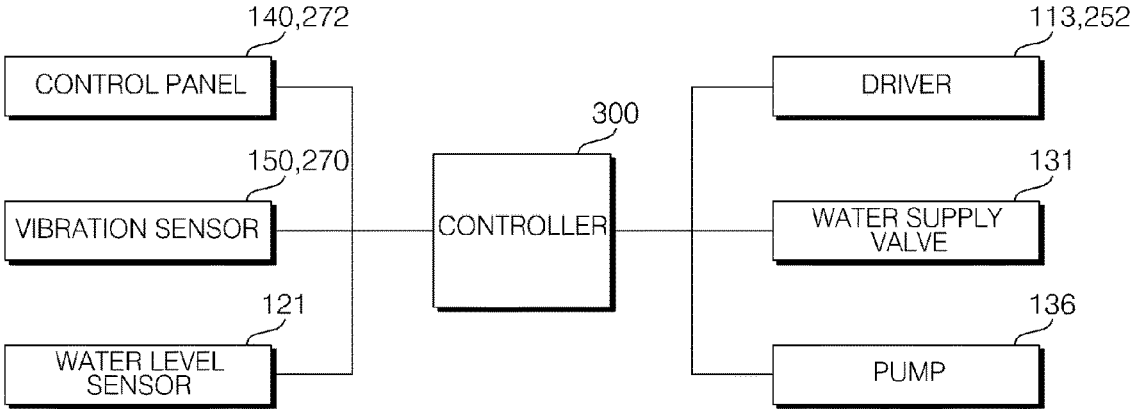
FIG. 4 is a block diagram of a laundry treatment machine including a controller in accordance with one embodiment of the present invention.

FIG. 4 is a block diagram of a laundry treatment machine including a controller in accordance with one embodiment of the present invention.

A laundry treatment machine in accordance with this embodiment may include a controller 300 which controls the overall operation of the laundry treatment machine 100 or 200 according to an operation command input through the control panel 114 or 272. The controller 300 may include a microcomputer which controls the operation of the laundry treatment machine, a storage device and other electronic parts. The controller 300 determines whether or not each cycle is performed, whether or not operations, such as water supply, washing, rinsing, draining, spin-drying and drying, are performed, times of these operations in each cycle, the number of repetitions of these operations, etc., according to on a washing course selected by a user, and thereby controls the water supply valve 131, the driver 113 or 252 and the pump 136.

The controller 300 controls the driver depending on the quantity of vibration of the tub 122 or 220 measured by the vibration sensor 150 or 270, and thereby adjusts the rotational speed of the drum 124 and 230. The controller 300 in accordance with this embodiment adjusts the rotational speed of the drum depending on each spin-drying operation.

Figure 5:
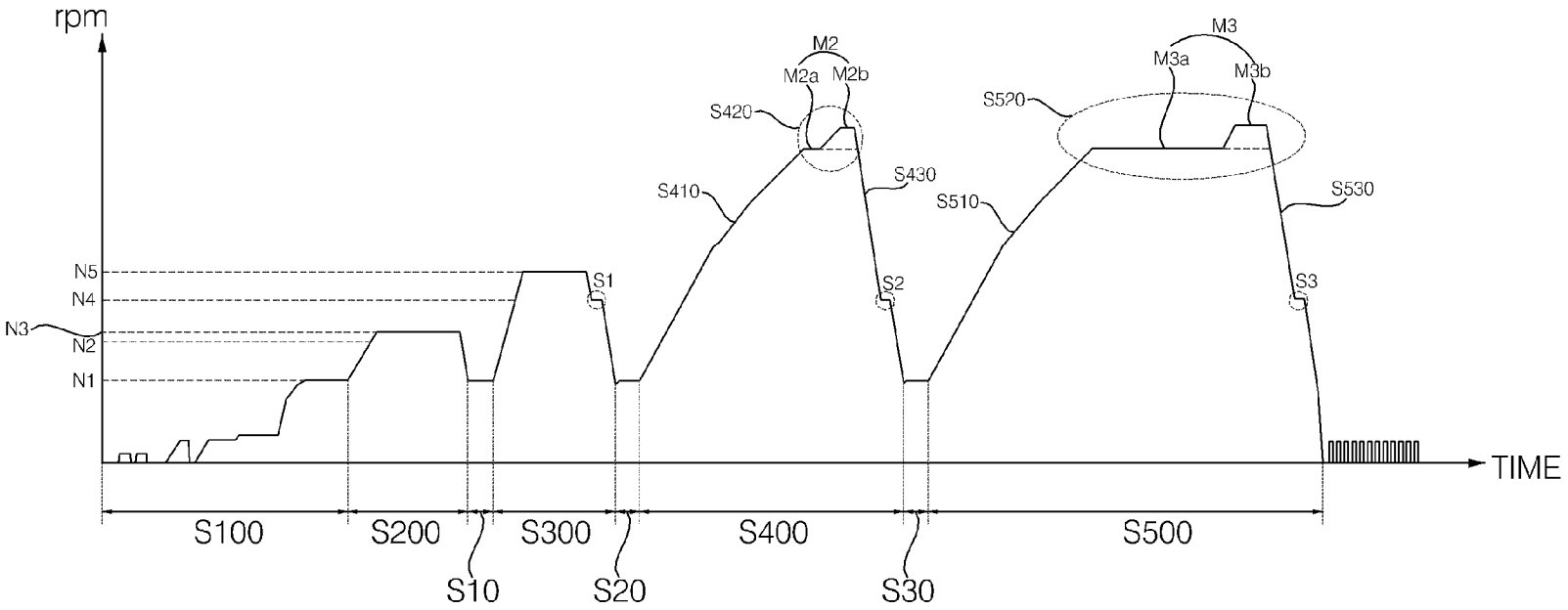
FIG. 5 is a view illustrating a rotational speed of a drum during a spin-drying cycle of the laundry treatment machine in accordance with one embodiment of the present invention.
Figure 6:
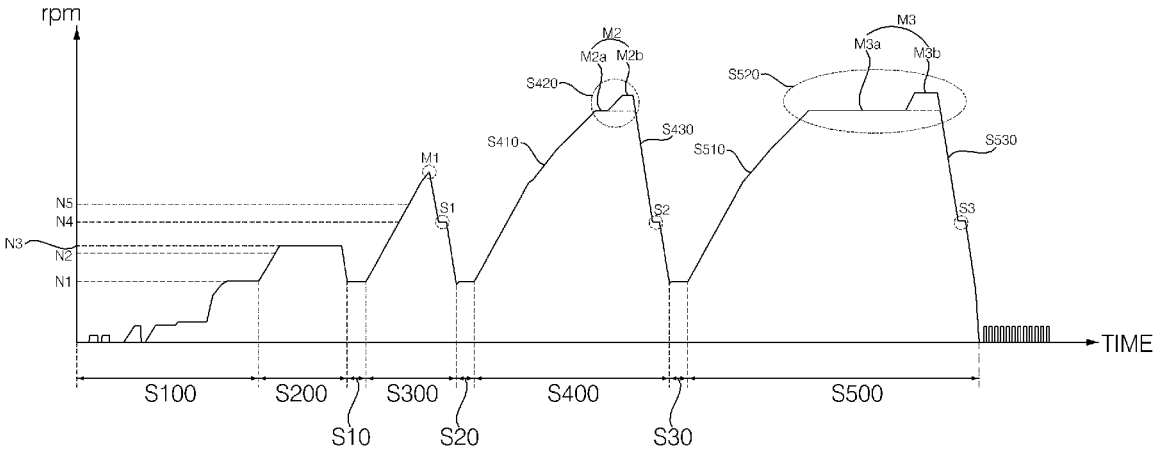
FIG. 6 is a view illustrating a rotational speed of the drum during a spin-drying cycle of the laundry treatment machine, in which a first spin-drying operation of FIG. 5 is modified.
Figure 7:
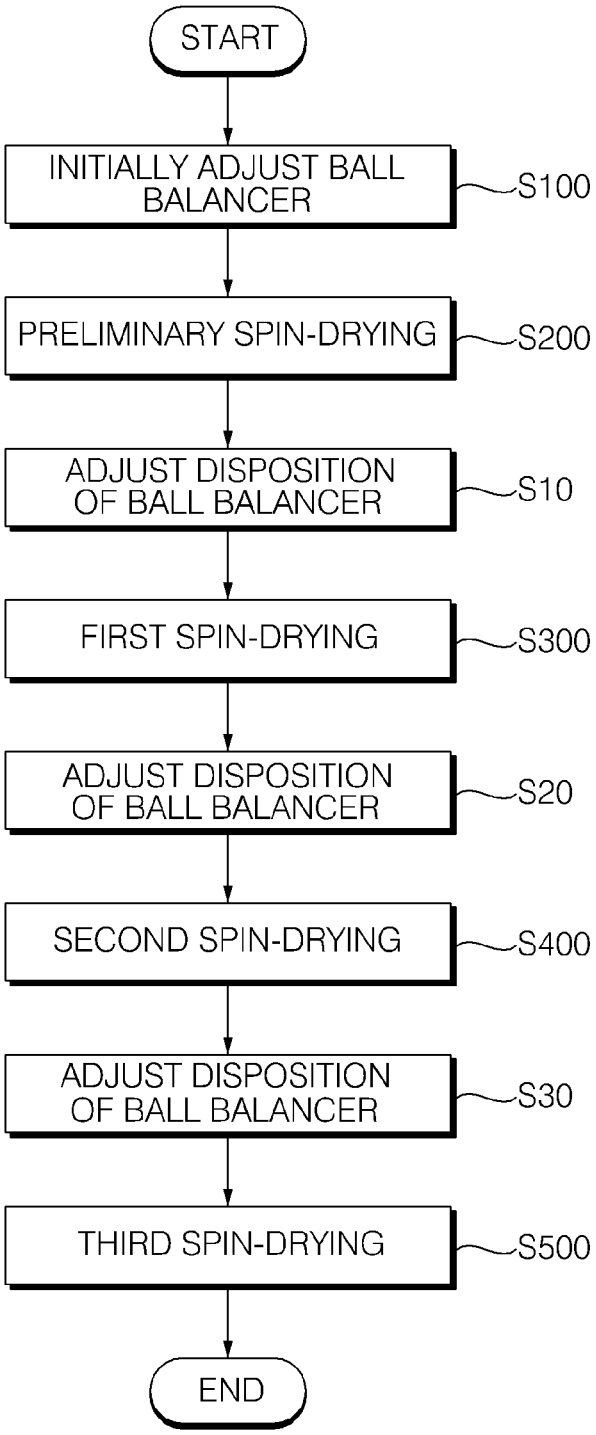
FIG. 7 is a flowchart illustrating a method for controlling the spin-drying cycle of the laundry treatment machine in accordance with one embodiment of the present invention.
Figure 8:
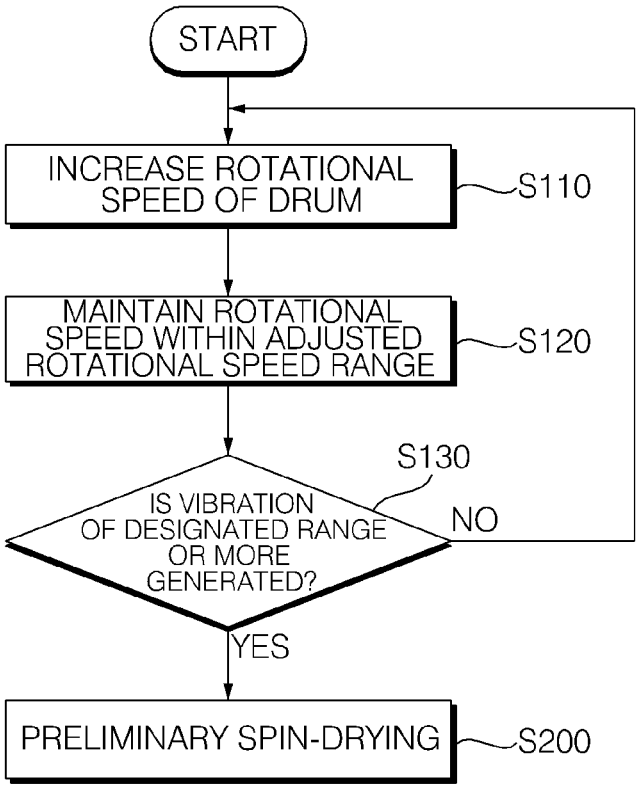
FIG. 8 is a flowchart illustrating in detail an initial ball balancer adjustment operation in the method for controlling the spin-drying cycle of the laundry treatment machine in accordance with one embodiment of the present invention.
Figure 9:
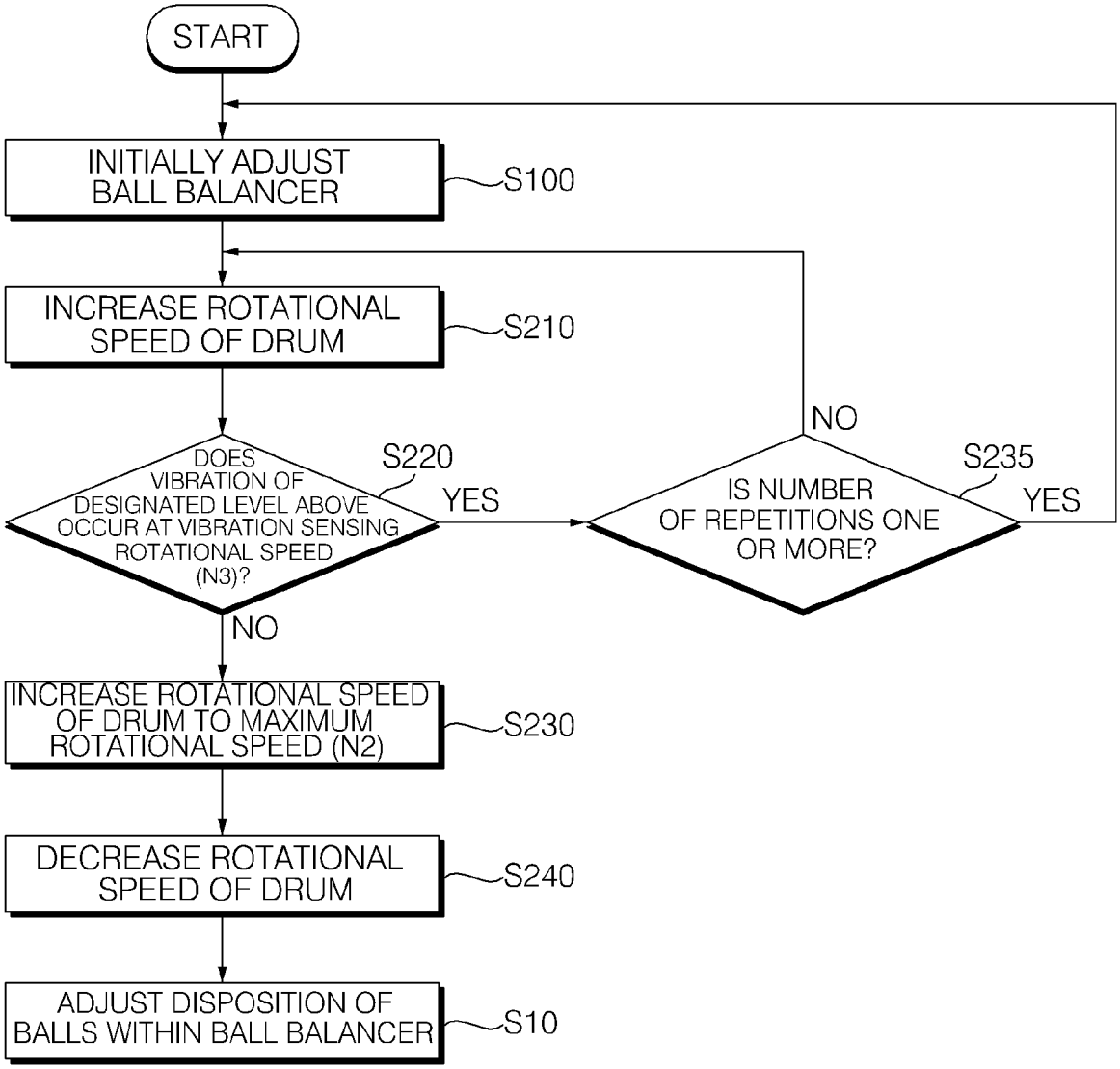
FIG. 9 is a flowchart illustrating in detail a preliminary spin-drying operation in the method for controlling the spin-drying cycle of the laundry treatment machine in accordance with one embodiment of the present invention.
Figure 10:
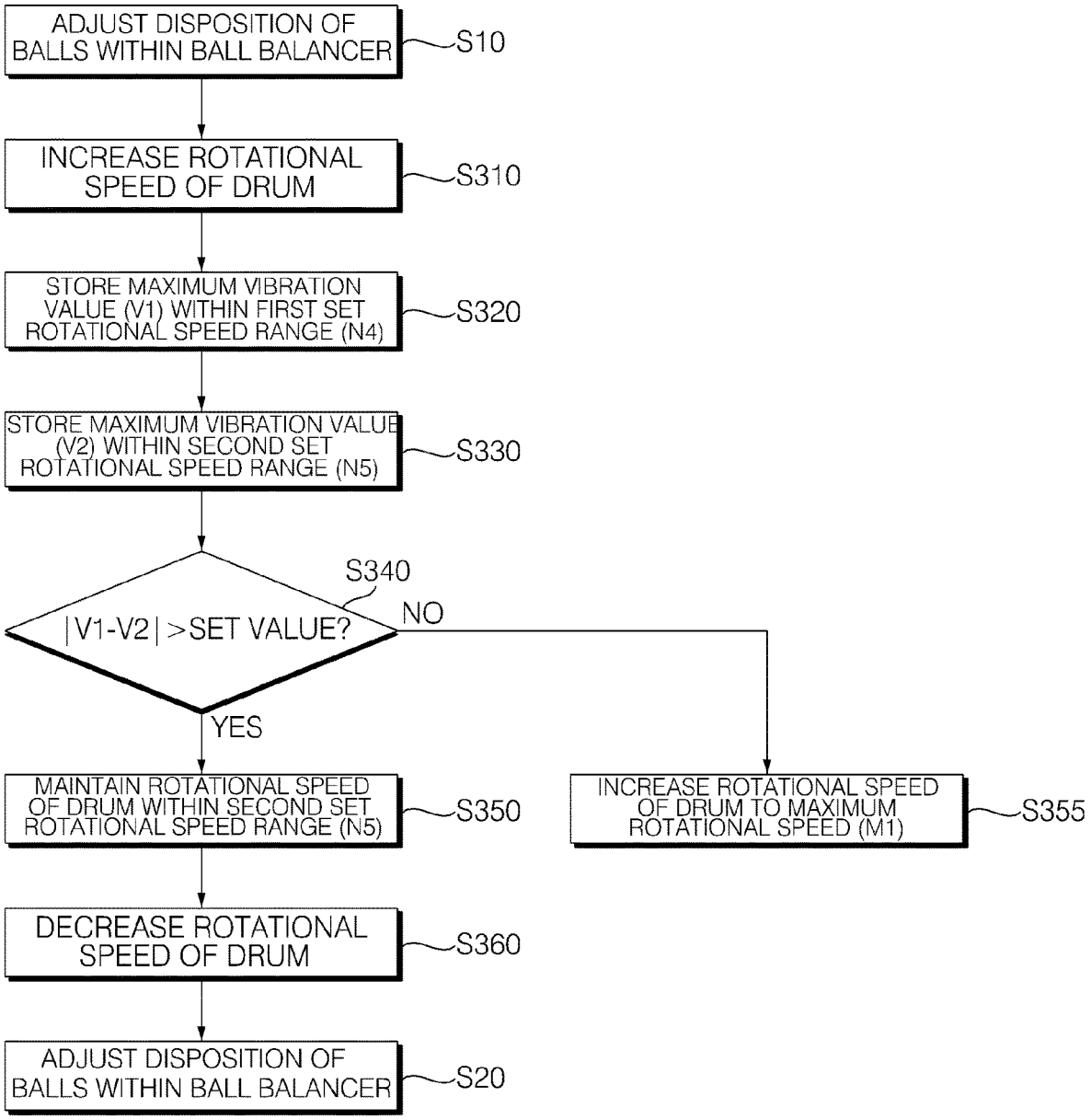
FIG. 10 is a flowchart illustrating in detail a first spin-drying operation in the method for controlling the spin-drying cycle of the laundry treatment machine in accordance with one embodiment of the present invention.

FIG. 5 is a view illustrating a rotational speed of a drum during a spin-drying cycle of the laundry treatment machine in accordance with one embodiment of the present invention. FIG. 6 is a view illustrating a rotational speed of the drum during a spin-drying cycle of the laundry treatment machine, in which a first spin-drying operation of FIG. 5 is modified. FIG. 7 is a flowchart illustrating a method for controlling the spin-drying cycle of the laundry treatment machine in accordance with one embodiment of the present invention. FIG. 8 is a flowchart illustrating in detail an initial ball balancer adjustment operation in the method for controlling the spin-drying cycle of the laundry treatment machine in accordance with one embodiment of the present invention. FIG. 9 is a flowchart illustrating in detail a preliminary spin-drying operation in the method for controlling the spin-drying cycle of the laundry treatment machine in accordance with one embodiment of the present invention. FIG. 10 is a flowchart illustrating in detail a first spin-drying operation in the method for controlling the spin-drying cycle of the laundry treatment machine in accordance with one embodiment of the present invention.

A method for controlling a spin-drying cycle of the laundry treatment machine in accordance with this embodiment includes performing a plurality of spin-drying operations by rotating the drum above an adjusted rotational speed range configured to adjust disposition the balls within the ball balancer so that the balls correspond to a change in an amount of eccentricity, and adjusting disposition of the balls within the ball balancer by rotating the drum within the adjusted rotational speed range, between the respective spin-drying operations.

Alternatively, the method for controlling the spin-drying cycle of the laundry treatment machine in accordance with this embodiment includes a plurality of spin-drying operations by rotating the drum above an adjusted rotational speed range configured to adjust disposition of the balls within the ball balancer so that the balls correspond to a change in an amount of eccentricity, and adjusting disposition of the balls within the ball balancer by rotating the drum within the adjusted rotational speed range, prior to each of the spin-drying operations.

Referring to FIGS. 1 to 3, in each of the laundry treatment machines 100 and 200 in accordance with the above-described embodiments, when clothes are accommodated in the drum 124 or 230 and then the drum 124 or 230 is rotated, great noise and vibration may be generated depending on the position of the clothes.

If the clothes are gathered in a partial region of the drum 124 or 230, an amount of eccentricity is generated when the drum 124 or 230 is rotated. Rotation of the drum 124 or 230 in the state in which the amount of eccentricity is caused by the clothes therein is referred to as eccentric rotation or unbalanced rotation. The eccentric rotation includes the case in which the drum 124 or 230 is rotated in a state in which the ball balancer does not correct the amount of eccentricity of the clothes, and the case in which the drum is rotated in a state in which the amount of eccentricity is changed due to removal of water during a spin-drying process.

Vibration occurring in the eccentrically rotated drum 124 or 230 may be reduced by the ball balancers 140 or 240 disposed at the front and rear portions of the drum 124 or 230. The balls 142 and 242 disposed in the balancer housing 144 or 244 of the ball balancer 140 or 240 are rotated while balancing the clothes, thus reducing vibration occurring from the cabinet 111 or 211. A plurality of balls 142 and 242 rotated along the inside of the balancer housing 144 or 244 is disposed in the balancer housing 144 or 244.

In the method for controlling the spin-drying cycle of the laundry treatment machine in accordance with this embodiment, which will be described below, vibration of the tub occurring due to an increase in the rotational speed of the drum is reduced using the ball balancers. Therefore, movement of the balls disposed in the balancer housing of the ball balancer depending on the rotational speed of the drum will be first described, and the method for controlling the spin-drying cycle of the laundry treatment machine will then be described.

As the drum 124 or 230 is rotated, the balls 142 or 242 disposed in the balancer housing 144 or 244 are rotated due to frictional force. The balls 142 or 242 in the balancer housing 144 or 244 are not confined by the drum, and are thus rotated at a different speed from that of the drum when the drum 124 or 230 is rotated. However, laundry causing eccentricity is pressed against the inner wall of the drum, and may be rotated at almost the same speed as the drum due to sufficient frictional force and lifts provide on the inner wall of the drum.

The rotational speed of the laundry and the rotational speed of the balls may be different, and, at an initial stage in which the drum starts to be rotated at a relatively low speed, the rotational speed of the laundry is higher than the rotational speed of the balls. To be precise, it may be considered that the rotational angular speed of the laundry is higher than the rotational angular speed of the balls. Further, a phase difference between the balls and the laundry, i.e., a phase difference therebetween with respect to the center of rotation of the drum, is continuously changed.

When the rotational speed of the drum is gradually increased, the balls are pressed against the circumferential surface of the outer side of the moving path due to centrifugal force, and, when the rotational speed of the drum is a designated value or more, the centrifugal force is increased, frictional force between the circumferential surface and the balls is a certain value or more, and thus, the balls are rotated at the same rotational speed as the drum.

Hereinafter, movement of the balls within the ball balancer according to the increase in the rotational speed of the drum 124 or 230 will be described. Disposition of the balls 142 or 242 within the balancer housing 144 or 244 is varied according to the rotational speed of the drum. When the drum 124 or 230 is not rotated, the balls 142 and 242 are disposed in the lower portion of the balancer housing 144 or 242 in a state in which the balls 142 and 242 are in contact with one another.

As the rotational speed of the drum 124 or 230 is increased at an initial stage of rotation, the balls 142 or 242 are rotated within the balancer housing 144 or 244 in a state in which the balls 142 or 242 are spaced apart from one another by a designated distance. In this case, gravity is more strongly applied to the balls than centrifugal force due to rotation of the drum 124 or 230, and thus, the rotational speeds of the balls may be different depending on the positions of the balls disposed in the balancer housing 144 or 244.

Thereafter, when the rotational speed of the drum 124 or 230 is further increased, the balls 142 and 242 are rotated within the balancer housing 144 or 242 within a range within which centrifugal force is more strongly applied to the balls than gravity in the state in which the balls are in contact with one another. In the laundry treatment machine in accordance with this embodiment, when the drum 124 or 230 is rotated at a speed of 130 RPM, the balls in the mutually contacting state are rotated within the balancer housing.

Thereafter, when the rotational speed of the drum 124 or 230 is further increased, the balls are spaced apart from one another and disposed so as to correspond to an amount of eccentricity of clothes rotated within the drum. Further, when the rotational speed of the drum is increased so that the drum is rotated within the adjusted rotational speed range, disposition of the balls rotated within the ball housing may be finely adjusted.

The adjusted rotational speed range is a section in which the disposition of the balls is finely adjusted in the state in which the balls are spaced apart from one another within the balancer housing by further increasing the rotational speed of the drum within the range within which centrifugal force is more strongly applied to the balls than gravity. In the laundry treatment machine in accordance with this embodiment, the adjusted rotational speed range N1 may be about 370 to 390 RPM, particularly about 380 RPM.

When wet clothes are excessively dewatered through rotation of the drum, the drum 124 or 230 may be eccentrically rotated due to change in the amount of eccentricity by a designated amount or more. This eccentric rotation is severed if the rotational speed of the drum is increased to a resonance point or higher, thus causing excessive vibration of the cabinet.

Therefore, by rotating the drum 124 or 230 within the adjusted rotational speed range, the eccentric rotation of the drum 124 or 230 may be corrected even if the amount of eccentricity is changed due to removal of water from the clothes.

When the rotational speed of the drum 124 or 230 is increased above the adjusted rotational speed range, the balls rotated within the balancer housing 144 or 244 are rotated at the rotational speed of the drum 124 of 230, and the disposition of the balls is almost fixed.

Therefore, it is difficult to adjust the disposition of the balls even if the amount of eccentricity is changed due to removal of water from the clothes. Thus, when the amount of eccentricity of the drum is changed by the designated range or more, the drum is eccentrically rotated and may thus cause vibration of the cabinet.

Hereinafter, the method for controlling the spin-drying cycle of the laundry treatment machine in accordance with this embodiment will be described with reference to FIGS. 5 to 10.

<Initial Ball Balancer Adjustment>

In the laundry treatment machine, the ball balancer is initially adjusted by draining water stored in the tub and increasing the rotational speed of the drum to the adjusted rotational speed range (operation S100). In the initial adjustment of the ball balancer, the controller 300 drains water remaining in the tub subsequent to the previous operation, and increases the rotational speed of the drum to the adjusted rotational speed range so that the balls disposed within the balancer housing 144 or 244 are disposed at a position corresponding to clothes.

In more detail, referring to FIG. 8, water stored in the tub 122 or 220 is drained, and the rotational speed of the drum is increased (operation S110). In this case, the controller 300 increases the rotational speed of the drum 124 or 230 to the adjusted rotational speed range.

When the rotational speed of the drum 124 or 230 is increased to the adjusted rotational speed range, the adjusted rotational speed range is maintained for a designated time (operation S120), and whether or not vibration of a designated level or above occurs due to rotation of the drum 124 or 230 is determined (operation S130).

As vibration occurring due to rotation of the drum 124 or 230, vibration of the tub in the forward and rearward directions or in the leftward and rightward directions is measured through the vibration sensor 150 or 270 disposed at the tub. When vibration sensed by the vibration sensor is the designated level or above, the controller 300 decreases the rotational speed of the drum to a designated speed or lower or stops the rotation of the drum, and then again increases the rotational speed of the drum (operation S110).

The reason for this is that, if the balls within the balancer housing 144 or 244 are not disposed at a position suitable for eccentricity of the clothes, excessive vibration of the cabinet occurs, and when the rotational speed of the drum is increased in this state, the vibration of the cabinet becomes severe due to eccentric rotation.

When the drum 124 or 230 is rotated at the adjusted rotational speed range, if vibration of the designated level or above does not occur, the controller 300 performs a preliminary spin-drying operation (operation S200).

<Preliminary Spin-Drying>

In the preliminary spin-drying operation (operation S200) in which a considerable amount of water is removed from the clothes, the drum 124 or 230 is rotated to a speed range corresponding to the resonance point of the cabinet 111 or 211 or lower. In the preliminary spin-drying (operation S200), the rotational speed of the drum 124 or 230 is increased to the speed range corresponding to the resonance point or lower in a state in which the clothes contain a large amount of water. In the preliminary spin-drying operation (operation S200), a sufficient amount of water is removed from the clothes so that the amount of eccentricity of the clothes is reduced, prior to the main spin-drying operation in which the drum is rotated to a rotational speed exceeding the resonance point.

In the preliminary spin-drying operation (operation S200), the rotational speed of the drum is increased to a maximum rotational speed N2 corresponding to the resonance point or lower (operation S210). In the preliminary spin-drying operation, the maximum rotational speed N2 of the drum is set to an RPM range of the resonance point of the cabinet or below. In the laundry treatment machine 100 or 200 in accordance with this embodiment, on the assumption that the resonance point of the cabinet occurs at about 950 RPM, the maximum rotational speed N2 of the drum in the preliminary spin-drying operation is 600 RPM.

During the process of increasing the rotational speed of the drum 124 or 230, whether or not vibration of the laundry treatment machine occurs when the rotational speed of the drum 124 or 230 is a vibration sensing rotational speed N3 is sensed (operation S220). The vibration sensing rotational speed N3 is set between the adjusted rotational speed range N1 and the maximum rotational speed N2 in the preliminary spin-drying operation. In this embodiment in which the maximum rotational speed N2 of the drum in the preliminary spin-drying operation is 600 RPM, the vibration sensing rotational speed N3 may be 540 to 560 RPM.

When vibration of the designated level or above occurs in the state in which the rotational speed of the drum 124 or 230 is the vibration sensing rotational speed N3, the controller 300 decreases the rotational speed of the drum to the adjusted rotational speed range N1. Thereafter, the rotational speed of the drum is again increased to the vibration sensing rotational speed N3, and whether or not vibration occurs is determined. Thereafter, when vibration sensed by the vibration sensor 150 or 270 is still the designated level or above, the controller 300 decreases the rotational speed of the drum to the designated speed or lower, or stops the rotation of the drum and then again perform the initial adjustment of the ball balancer (operation S100).

That is, upon determining that vibration of the designated level or above occurs at least once in the state in which the rotational speed of the drum 124 or 230 is the vibration sensing rotational speed N3, the controller 300 decreases the rotational speed of the drum to the designated speed or lower, or stops the rotation of the drum and then again perform the initial adjustment of the ball balancer (operation S100).

Upon determining that vibration of the designated level or above does not occur in the state in which the rotational speed of the drum 124 or 230 is the vibration sensing rotational speed N3, the controller 300 increases the rotational speed of the drum to the maximum rotational speed N2 in the preliminary spin-drying operation (operation S230).

Thereafter, the rotational speed of the drum is decreased to the adjusted rotational speed range (operation S240). The controller 300 maintains the maximum rotational speed N2 for a designated time, and then decreases the rotational speed of the drum 124 or 230 to the adjusted rotational speed range N1. The maximum rotational speed N2 is maintained for the designated time so as to maximally remove water from the clothes in the preliminary spin-drying operation (operation S200).

Thereafter, the controller 300 decreases the rotational speed of the drum 124 or 230 to the adjusted rotational speed range N1, and then adjusts disposition of the balls within the ball balancer (operation S10).

<Ball Balancer Disposition Adjustment>

In the laundry treatment machine in accordance with this embodiment, disposition of the balls within the ball balancer is adjusted several times during a process of the spin-drying cycle (operations S10, S20 and S30). In the adjustment of the disposition of the ball balancer (operations S10, S20 and S30), disposition of the balls 142 or 242 rotated within the balancer housing 144 or 244 is finely adjusted by rotating the drum 124 or 230 within the adjusted rotational speed range N1.

In the case of laundry having been subjected to the preliminary spin-drying (operation S200) or each spin-drying (operation S300, S400 or S500) which will be described below, the amount of eccentricity of the laundry is varied according to variables, such as the kind of the laundry, the amount of removed water, etc. The amount of eccentricity of the laundry having been subjected to each spin-drying operation (operation S200, S300, S400 or S500) is generally changed to be decreased, but in some cases, the amount of eccentricity of the laundry may be changed to be increased due to variables, such as the kind of the laundry, a region of the laundry from which water is removed, etc.

In each spin-drying operation (operation S200, S300, S400 or S500), the drum is rotated above the adjusted rotational speed range N1, and thus, it is difficult to change disposition of the balls within the balancer housing 144 or 244 to a position corresponding to the change in the amount of eccentricity. Therefore, in the method for controlling the spin-drying cycle of the laundry treatment machine in accordance with this embodiment, the disposition of the balls within the ball balancer is adjusted (operation S10, S20 or S30) between the respective spin-drying operations (operation S200, S300, S400 and S500), and thereby, the balls within the balancer housing 144 or 244 are finely adjusted so as to correspond to the change in the amount of eccentricity due to removal of water.

<Main Spin-Drying>

In the main spin-drying operation, the drum is rotated at a rotational speed of above the resonance point, after the preliminary spin-drying operation. In the main spin-drying, if a designated condition is satisfied, the drum is rotated at the rotational speed of above the resonance point. The main spin-drying operation includes accelerating rotation of the drum by increasing the rotational speed of the drum 124 or 230 to a maximum value of each operation, and decelerating rotation of the drum by decreasing the rotational speed of the drum 124 or 230 from the maximum value to the value corresponding to the adjustment of the disposition of the balls within the ball balancer. Further, the main spin-drying operation may further include maintaining the rotational speed of the drum 124 or 230 at the maximum value of each operation.

The main spin-drying operation in accordance with this embodiment may include a first spin-drying operation performed by rotating the drum at a rotational speed of above the resonance point of the cabinet (operation S300), a second spin-drying operation performed by rotating the drum at a maximum rotational speed higher than a maximum rotational speed of the drum in the first spin-drying operation (operation S400), and a third spin-drying operation performed by rotating the drum at a maximum rotational speed for a longer time than in the second spin-drying operation (operation S500).

Hereinafter, the respective spin-drying operations will be described in detail.

<First Spin-Drying>

Referring to FIG. 5, in the first spin-drying operation (operation S300), the drum 124 or 230 is rotated within an RPM range of above the resonance point of the cabinet. In the first spin-drying operation (operation S300), the drum is rotated within a range between the resonance point of the cabinet and a maximum rotational speed M2 or M3 in the second or third spin-drying operation. In the first spin-drying operation, the drum 124 or 230 is rotated within a range between the resonance point of the cabinet and a resonance point of the door 1.

A maximum rotational speed M1 of the drum in the first spin-drying operation is set to be lower than the maximum rotational speed M2 or M3 of the drum in the second or third spin-drying operation. Since the amount of removed water in the first spin-drying operation is greater than in the second spin-drying operation or the third spin-drying operation and thus a change in the amount of eccentricity in the first spin-drying operation is relatively large, the maximum rotational speed M1 of the drum in the first spin-drying operation is set to be lower than the maximum rotational speed M2 or M3 of the drum in the second or third spin-drying operation. In the laundry treatment machine 100 or 200 in accordance with this embodiment, the maximum rotational speed M1 is within the range of about 1000 to 1100 RPM.

In the first spin-drying operation, when the change in the amount of eccentricity due to removal of water during rotation of the drum within the RPM range of the resonance point of the cabinet or lower is a set range or below, the drum is rotated to the maximum rotational speed M1, as shown in FIG. 5. In the first spin-drying operation, when the change in the amount of eccentricity due to removal of water during rotation of the drum to the resonance point of the cabinet or lower is great, the drum is rotated to the resonance point of the cabinet or lower, as shown in FIG. 6. The rotation of the drum to the resonance point or lower may serve to prevent excessive vibration of the cabinet occurring due to rotation of the drum at the resonance point or higher.

Referring to FIG. 9, in the first spin-drying operation (operation S300), in detail, the rotational speed of the drum is increased (operation S310), after the adjustment of the disposition of the balls within the ball balancer (operation S10). The controller 300 increases the rotational speed of the drum which is rotated within the adjusted rotational speed range N1.

During the process of increasing the rotational speed of the drum 124 or 230, a maximum vibration value V1 sensed within a first set rotational speed range N4 is stored (operation S320), and a maximum vibration value V2 sensed within a second set rotational speed range N5 is stored (operation S330).

The second set rotational speed range N5 is set to have a higher RPM range than that of the first set rotational speed range N4. The first set rotational speed range N4 and the second set rotational speed range N5 are set to be within an RPM range of the resonance point or lower. The first set rotational speed range N4 and the second set rotational speed range N5 may be set as sections in which removal of water is the greatest in the first spin-drying operation.

In the laundry treatment machine 100 or 200 in accordance with this embodiment, the first set rotational speed range N4 may be set to a range within which the rotational speed of the drum 124 or 230 is 649 RPM to 651 RPM, and the second set rotational speed range N5 may be set to a range within which the rotational speed of the drum 124 or 230 is 749 RPM to 751 RPM.

Thereafter, a difference between the maximum vibration value V1 within the first set rotational speed range N4 and the maximum vibration value V2 within the second set rotational speed range N5 is determined (operation S340). As the difference between the vibration values is increased, vibration of the cabinet of the designated level or above may occur when the rotational speed of the drum 124 and 230 is increased to resonance point.

Therefore, when the difference between the maximum vibration value V1 within the first set rotational speed range N4 and the maximum vibration value V2 within the second set rotational speed range N5 exceeds a set value, the controller 300 maintains the rotational speed of the drum 124 or 230 within the second set rotational speed range N5 (operation S350). The maintenance of the rotational speed of the drum 124 or 230 within the second set rotational speed range N5 includes maintaining one rotational speed of the drum within the second set rotational speed range N5, or changing the rotational speed of the drum within the second set rotational speed range N5. For example, the finally increased rotational speed of the drum 124 or 230 within the second set rotational speed range N5 may be maintained, the rotational speed of the drum 124 or 230 indicating a minimum vibration value among vibration values measured in the second set rotational speed range N5 may be maintained, or the minimum rotational speed of the drum within the second set rotational speed range N5 may be maintained. The maintenance of the rotational speed of the drum 124 or 230 within the second set rotational speed range N5 may be variously set in the same manner as in the satisfaction of the second set rotational speed range N5.

When the difference between the maximum vibration value V1 within the first set rotational speed range N4 and the maximum vibration value V2 within the second set rotational speed range N5 is the set value or less, the controller 300 increases the rotational speed of the drum to the maximum rotational speed M1 in the first spin-drying operation (operation S355). In this embodiment, whether or not the difference between the maximum vibration value V1 in the first set rotational speed range N4 and the maximum vibration value V2 in the second set rotational speed range N5 exceeds 100 is determined.

In the maintenance of the second set rotational speed range N5 (operation S350), a maintenance period may be set so that the same amount of water as the amount of water removed in the increase of the rotational speed of the drum to the maximum rotational speed (operation S360) may be removed. In accordance with this embodiment, the period to maintain the second set rotational speed range may be set to 120 seconds, and such a value is merely one embodiment and thus the maintenance period may be changed within a range within which the same amount of water as the amount of water removed in the increase in the rotational speed of the drum to the maximum rotational speed (operation S355) is removed.

Thereafter, the controller 300 decreases the rotational speed of the drum (operation S360). The rotational speed of the drum is decreased to the adjusted rotational speed range, and then the disposition of the ball balancer is adjusted (operation S20). The decrease of the rotational speed of the drum (operation S360) includes a ball disposition maintenance section S1. The ball disposition maintenance section S1 prevents excessive vibration of the cabinet occurring during the process of decreasing the rotational speed of the drum. When the rotational speed of the drum is rapidly decreased, the disposition of the balls within the balancer housing 144 or 244 is changed and thus excessive vibration of the cabinet may occur due to eccentric rotation of the drum, and therefore, the ball disposition maintenance section S1 is provided so as to prevent such a problem. The ball disposition maintenance section S1 in accordance with this embodiment may be formed within the range of 650 RPM. However, this is merely one embodiment, and the rotational speed range of the drum 124 or 230 in the ball disposition maintenance S1 may be variously set within a range within which the disposition of the balls within the balancer housing 144 or 244 is not changed during the decrease of the rotational speed of the drum.

The controller 300 adjusts the disposition of the balls within the ball balancer by decreasing the rotational speed of the drum to the adjusted rotational speed range N1 (operation S20).

<Second Spin-Drying>

In the second spin-drying operation (operation S400), the drum is rotated within an RPM range of above the resonance point. The maximum rotational speed M2 in the second spin-drying operation (operation S400) is set to be higher than the maximum rotational speed M1 of the drum in the first spin-drying operation (operation S300).

The maximum rotational speed of the drum in the second spin-drying operation (operation S400) in accordance with this embodiment is set within the range of about 1440 to 1600 RPM. The maximum rotational speed M2 of the drum 124 or 230 in the second spin-drying operation (operation S400) may be divided into a first maximum rotational speed M2*a* and a second maximum rotational speed M2*b*. The controller 300 may increase the rotational speed of the drum 124 or 230 to the first maximum rotational speed M2*a*, and then increase the rotational speed of the drum 124 or 230 to the second maximum rotational speed M2*b* when vibration sensed by the vibration sensor 150 or 270 is below the designated level. However, when the drum 124 or 230 is rotated at the first maximum rotational speed M2*a* and the vibration sensed by the vibration sensor 150 or 270 is the designated level or above, the controller 300 maintain the first maximum rotational speed M2*a* of the drum 124 or 230. In this case, a section in which rotational speed of the drum is increased to the second maximum rotational speed M2*b* is omitted.

The second spin-drying operation includes increasing the rotational speed of the drum to the maximum rotational speed (operation S410), maintaining the rotational speed of the drum at the maximum rotational speed (operation S420), and decreasing the rotational speed of the drum from the maximum rotational speed to the adjusted rotational speed range (operation S430).

The decrease of the rotational speed of the drum (operation S430) in the second spin-drying operation includes a ball disposition maintenance section S2 to prevent excessive vibration of the cabinet occurring during the process of decreasing the rotational speed of the drum, in the same manner as in the first spin-drying operation.

<Third Spin-Drying>

In the third spin-drying operation (operation S500), the drum is rotated within an RPM range of above the resonance point. The maximum rotational speed M3 in the third spin-drying operation (operation S500) is set to be higher than the maximum rotational speed of the drum in the first spin-drying operation (operation S300).

The maximum rotational speed of the drum in the third spin-drying operation (operation S500) in accordance with this embodiment is set within the range of about 1440 to 1600 RPM. The maximum rotational speed M3 of the drum 124 or 230 in the third spin-drying operation (operation S500) may be divided into a first maximum rotational speed M3*a* and a second maximum rotational speed M3*b*. The controller 300 may increase the rotational speed of the drum 124 or 230 to the first maximum rotational speed M3*a*, and then increase the rotational speed of the drum 124 or 230 to the second maximum rotational speed M3*b* when vibration sensed by the vibration sensor 150 or 270 is below the designated level. However, when the drum 124 or 230 is rotated at the first maximum rotational speed M3*a* and the vibration sensed by the vibration sensor 150 or 270 is the designated level or above, the controller 300 maintain the first maximum rotational speed M3*a* of the drum 124 or 230.

The third spin-drying operation includes increasing the rotational speed of the drum to the maximum rotational speed (operation S510), maintaining the rotational speed of the drum at the maximum rotational speed (operation S520), and decreasing the rotational speed of the drum from the maximum rotational speed to the adjusted rotational speed range (operation S530).

A time taken to maintain the rotational speed of the drum at the maximum rotational speed (operation S520) in the third spin-drying operation (operation S500) may be set to be longer than a time taken to maintain the rotational speed of the drum at the maximum rotational speed (operation S420) in the second spin-drying operation (operation S400). The amount of water removed from the laundry in the third spin-drying operation is less than the amount of water removed from the laundry in the second spin-drying operation, and thus, the time taken to maintain the rotational speed of the drum at the maximum rotational speed in the third spin-drying operation may be set to be longer than the time taken to maintain the rotational speed of the drum at the maximum rotational speed in the second spin-drying operation.

The decrease of the rotational speed of the drum (operation S450) in the third spin-drying operation includes a ball disposition maintenance section S3 to prevent excessive vibration of the cabinet occurring during the process of decreasing the rotational speed of the drum, in the same manner as in the first spin-drying operation or the second spin-drying operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for controlling a spin-drying cycle of a laundry treatment machine, the method comprising:

performing a plurality of spin-drying operations by rotating a drum above an adjusted rotational speed range configured to adjust disposition of balls within a ball balancer so as to correspond to a change in an amount of eccentricity; and adjusting the disposition of the balls within the ball balancer by rotating the drum within the adjusted rotational speed range, between the respective spin-drying operations, wherein the adjusted rotational speed range is lower than an RPM range of a resonance point of a cabinet, and wherein the plurality of spin-drying operations comprise:

a first spin-drying operation including a section at which the drum rotates at a first rotational speed above the resonance point of the cabinet;

a second spin-drying operation including a section at which the drum rotates at a second rotational speed higher than a first rotational speed; and a third spin-drying operation rotating the drum at a third rotational speed, higher than or equal to the second rotational speed, for a longer time than in the second spin-drying operation, wherein the disposition of the balls with the ball balancer is adjusted by rotating the drum within the adjusted rotational speed range, between the second spin-drying operation and the third spin-drying operation.

2. The method according to claim 1, wherein the spin-drying operations further comprise:

a preliminary spin-drying operation performed by rotating the drum within the RPM range of the resonance point of the cabinet or lower, wherein the disposition of the balls within the ball balancer is adjusted by rotating the drum within the adjusted rotational speed range, between the preliminary spin-drying operation and the first spin-drying operation.

3. The method according to claim 1, wherein the second spin-drying operation comprises accelerating the drum from the second rotational speed to a maximum rotational speed when vibration occurring due to the rotation of the drum at the second rotational speed is below a designated level.

4. The method according to claim 1, wherein the third rotational speed in the third spin-drying operation is divided into a first maximum rotational speed and a second maximum rotational speed higher than the first maximum rotational speed, and wherein the third spin-drying operation comprises:

accelerating rotation of the drum from the first maximum rotational speed to the second maximum rotational speed when vibration occurring due to the rotation of the drum at the first maximum rotational speed is below a designated level.

5. The method according to claim 1, wherein, in the first spin-drying operation, if the change in the amount of eccentricity due to removal of water exceeds a set range during the rotation of the drum, the drum is rotated at the rotational speed of the resonance point of the cabinet or lower.

6. The method according to claim 1, wherein, in the first spin-drying operation, when a difference between a maximum vibration value within a first set rotational speed range set to the resonance point or lower, and a maximum vibration value within a second set rotational speed range set to the resonance point or lower, which is higher than the first set rotational speed range, exceeds a set value, the rotational speed of the drum is maintained within the second set rotational speed range.

7. The method according to claim 6, wherein, in the first spin-drying operation, the first set rotational speed range and the second set rotational speed range are set as sections in which removal of water exceeds a set range.

8. The method according to claim 2, wherein each of the first, second, and third spin-drying operation comprises:

increasing the rotational speed of the drum to a maximum rotational speed; and decreasing the rotational speed of the drum from the maximum rotational speed, wherein the decreasing the rotational speed of the drum comprises a ball disposition maintenance section maintaining rotational speed of the drum for a certain time.

9. The method according to claim 2, further comprising:

initially adjusting the disposition of the balls within the ball balancer by draining water stored in a tub and increasing a rotational speed of the drum to the adjusted rotational speed range, prior to the preliminary spin-drying operation.

10. The method according to claim 9, wherein, in the initially adjusting the disposition of the balls within the ball balancer, when the drum is rotated within the adjusted rotational speed range, if vibration of a designated level or above is generated, the rotational speed of the drum is decreased or rotation of the drum is stopped.

11. The method according to claim 2, wherein the preliminary spin-drying operation comprises:

increasing a rotational speed of the drum;

sensing whether or not vibration occurs at a vibration sensing rotational speed set between the adjusted rotational speed range and a maximum rotational speed in the preliminary spin-drying; and increasing the rotational speed of the drum to the maximum rotational speed, when vibration of below a designated level occurs at the vibration sensing rotational speed, wherein:

when vibration of the designated level or above occurs at the vibration sensing rotational speed, the rotational speed of the drum is decreased to the adjusted rotational speed range; and when the decrease of the rotational speed of the drum to the adjusted rotational speed range is repeated at least once, the rotational speed of the drum is decreased to the adjusted rotational speed range or below, or rotation of the drum is stopped.

* * * * *